US010739020B2

(12) United States Patent
Kim et al.

(10) Patent No.: US 10,739,020 B2
(45) Date of Patent: Aug. 11, 2020

(54) OUTDOOR UNIT OF AIR CONDITIONER

(71) Applicant: Samsung Electronics Co., Ltd., Suwon-si (KR)

(72) Inventors: Mun Sub Kim, Suwon-si (KR); Hyun-Wuk Kang, Suwon-si (KR); Hoon Yeong Koh, Suwon-si (KR); You Jae Kim, Suwon-si (KR); Hyeong Joon Seo, Suwon-si (KR); Du Han Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 93 days.

(21) Appl. No.: 15/697,579

(22) Filed: Sep. 7, 2017

(65) Prior Publication Data

US 2018/0073750 A1 Mar. 15, 2018

(30) Foreign Application Priority Data

Sep. 9, 2016 (KR) ..... 10-2016-0116439

(51) Int. Cl.
*F24F 1/56* (2011.01)
*F24F 1/40* (2011.01)
(Continued)

(52) U.S. Cl.
CPC ..... *F24F 1/56* (2013.01); *F24F 1/38* (2013.01); *F24F 1/40* (2013.01); *F24F 1/50* (2013.01)

(58) Field of Classification Search
CPC ..... F24F 1/18; F24F 1/38; F24F 1/40; F24F 1/50; F24F 1/56; F24F 5/00; F04D 29/00; F04D 29/52; F04D 29/526; F04D 29/56
(Continued)

(56) References Cited

U.S. PATENT DOCUMENTS 6,705,105 B2 * 3/2004 Wendt ..... F24F 1/18 312/257.1
7,971,448 B2 * 7/2011 Kim ..... F04D 29/541 62/285
(Continued)

FOREIGN PATENT DOCUMENTS

EP 2623876 A3 * 12/2012 ..... F24F 1/38
EP 3040631 7/2016
(Continued)

OTHER PUBLICATIONS

Machine Translation JP 2003214660A (Year: 2003).*
(Continued)

*Primary Examiner* — Keith M Raymond
*Assistant Examiner* — Gustavo A Hincapie Serna
(74) *Attorney, Agent, or Firm* — Staas & Halsey LLP

(57) ABSTRACT

An outdoor unit of an air conditioner includes a cabinet including a first plate and a second plate, a blower disposed inside the cabinet, and a blower cover covering the blower and an upper side of the cabinet. The first plate includes a contact area in contact with the blower cover in an outward direction of the cabinet, and the second plate includes a first non-contact area that is not in contact with the blower cover in the outward direction of the cabinet. The blower cover is disposed on one of four plates of the cabinet to reduce the noise generated due to the vibration of the cabinet by reducing the vibration transmitted from the blower cover to the cabinet.

16 Claims, 17 Drawing Sheets

(51) Int. Cl.
*F24F 1/38* (2011.01)
*F24F 1/50* (2011.01)

(58) Field of Classification Search
USPC ..... 165/120, 121, 125; 62/259.1, 398, 301
See application file for complete search history.

(56) References Cited

U.S. PATENT DOCUMENTS

| | | | | |
|---|---|---|---|---|
| 2007/0163295 | A1* | 7/2007 | Martin, Sr. | F24F 1/08 62/507 |
| 2013/0091889 | A1* | 4/2013 | Kim | F24F 1/14 62/426 |
| 2013/0239605 | A1* | 9/2013 | Oh | F04D 25/08 62/428 |
| 2015/0027670 | A1* | 1/2015 | Jinnai | F24F 1/16 165/121 |
| 2015/0054393 | A1* | 2/2015 | Lee | F24F 13/20 312/236 |
| 2015/0211756 | A1* | 7/2015 | Jeong | F24F 1/0014 454/248 |
| 2016/0187006 | A1* | 6/2016 | Koo | F24F 1/56 62/259.1 |
| 2016/0187007 | A1* | 6/2016 | Kwon | F24F 1/60 62/259.1 |
| 2017/0074526 | A1* | 3/2017 | Colantuoni | F24F 1/50 |
| 2018/0266723 | A1* | 9/2018 | Mori | F24F 13/24 |

FOREIGN PATENT DOCUMENTS

| | | | | | |
|---|---|---|---|---|---|
| JP | 2-37239 | | | 2/1990 | |
| JP | 2003214660 | A | * | 7/2003 | F24F 5/00 |
| JP | 2010127595 | A | * | 6/2010 | F24F 5/00 |
| JP | 2010127595 | A | * | 6/2010 | |
| JP | 2012-242025 | | | 12/2012 | |
| KR | 10-2005-0024157 | | | 3/2005 | |
| KR | 10-2005-0088610 | | | 9/2005 | |
| KR | 10-2006-0020919 | | | 3/2006 | |
| KR | 10-2006-0068711 | | | 6/2006 | |
| KR | 10-2006-0109164 | | | 10/2006 | |
| KR | 10-2015-0091616 | | | 8/2015 | |

OTHER PUBLICATIONS

JP-2010127595A Machine Translation (Year: 2010).*
Extended European Search Report dated Mar. 12, 2018 in European Patent Application No. 17190234.9.
Chinese Office Action dated Sep. 4, 2019 in Chinese Patent Application No. 201710811011.1.
Chinese Office Action dated Apr. 20, 2020 in Chinese Patent Application No. 201710811011.1.
European Office Action dated Mar. 25, 2020 in European Patent Application No. 17190234.9.

* cited by examiner

OUTDOOR UNIT OF AIR CONDITIONER

CROSS-REFERENCE TO RELATED APPLICATIONS

This application claims the benefit of Korean Patent Application No. 10-2016-0116439, filed on Sep. 9, 2016 in the Korean Intellectual Property Office, the disclosure of which is incorporated herein by reference.

BACKGROUND

1. Field

Embodiments of the present disclosure relate to an outdoor unit of an air conditioner, and more particularly, to a cabinet of the outdoor unit.

2. Description of the Related Art

Generally, an air conditioner uses a refrigeration cycle to control the temperature, humidity, airflow, air distribution, etc. suitable for human activity and to remove dust and the like in the air. A compressor, a condenser, an evaporator, a blower, etc. are the main components of the refrigeration cycle.

In the case of a separate type air conditioner in which an outdoor unit and an indoor unit of the air conditioner are separately installed, a compressor, an outdoor heat exchanger (hereinafter, referred to as a heat exchanger) and a blower are provided in the outdoor unit.

The outdoor unit of the air conditioner makes noise or suffers from reliability issues because vibration of the blower itself and vibration generated from air discharging are moved to a cabinet that constitutes the exterior of the outdoor unit.

SUMMARY

One aspect of the present disclosure provides an outdoor unit of an air conditioner having an improved coupling structure between a blower cover and a cabinet for reducing vibration of an outdoor unit of the air conditioner.

In accordance with one aspect of the present disclosure, an outdoor unit of an air conditioner includes a cabinet including a first plate and a second plate, a blower disposed inside the cabinet, a blower cover covering the blower and an upper side of the cabinet.

The first plate includes a contact area in contact with the blower cover in an outward direction of the cabinet, and the second plate includes a first non-contact area that is not in contact with the blower cover in the outward direction of the cabinet.

The first plate further includes a second non-contact area that is not in contact with the blower cover in the outward direction of the cabinet.

The contact area is provided in two contact areas so as to be disposed on both end sides of the first plate, the second non-contact area is provided between the two contact areas.

The second non-contact area includes a bent portion extending to be bent toward the inside of the cabinet and an inner side portion extending upward from the bent portion.

The blower cover is disposed apart from the inner side portion in the outward direction of the cabinet.

The blower cover includes an upper surface disposed on the upper side of the cabinet and an extension bent downward from the upper surface and extending downward, and the extension includes a contact portion corresponding to the contact area and a non-contact portion corresponding to the first and second non-contact area.

The contact area includes a coupling portion engaged with the contact portion by a coupling member.

The coupling portion is provided in coupling portions to be respectively disposed on both end sides of the first plate.

The non-contact portion includes a bead protruding in the outward direction of the cabinet.

The bead is disposed apart from the first and second non-contact areas in the outward direction of the cabinet.

The extension is disposed apart from the second plate in an outward direction of the cabinet not to be in contact with the second plate.

The first plate is disposed in an orthogonal direction with respect to the second plate, and the second plate is hooked on the first plate.

The second plate includes a hook formed on one side of an inner surface of the second plate, and the first plate includes a coupling surface bent toward the second plate and coupled with the inner surface of the second plate, and the coupling surface includes a hook groove in which the hook is hooked.

The other side of the inner surface of the second plate is coupled with the coupling surface by a coupling member.

The outdoor unit of the air conditioner further includes a vibroisolating member disposed between an inner surface of the upper surface and an upper side of the second plate.

The vibroisolating member comprises an insertion groove into which an upper end of the second plate is inserted.

In accordance with another aspect of the present disclosure, an outdoor unit of an air conditioner includes a cabinet including a pair of first plates and a pair of second plates, a blower disposed inside the cabinet, a blower cover covering the blower and an upper side of the cabinet.

The cabinet further comprises a contact area in contact with the blower cover in an outward direction of the cabinet and a non-contact area not in contact with the blower cover, and the contact area is disposed only on the pair of first plates.

The non-contact area includes a first non-contact area disposed on the pair of first plates and a second non-contact area disposed on the pair of second plates, and the blower cover includes a contact portion corresponding to the contact area, a first non-contact portion and a second non-contact portion corresponding to the first non-contact area and the second non-contact area, and the first non-contact portion includes a bead protruding in the outward direction of the cabinet.

The first non-contact portion is disposed apart from the first plate in the outward direction of the cabinet, and the second non-contact portion is disposed apart from the second plate in the outward direction of the cabinet.

The first non-contact area includes a bent portion bent toward the inside of the cabinet and an inner side portion extending upward from the bent portion, and the inner side portion is disposed apart from the bead in the outward direction of the cabinet.

In accordance with the other aspect of the present disclosure, an outdoor unit of the air conditioner includes a cabinet including a first plate and a second plate, a blower disposed inside the cabinet, a blower cover covering the blowing fan and an upper side of the cabinet.

The blower cover includes at least two contact portions that are in contact with the first plate in the outward direction of the cabinet, a first non-contact portion which is disposed between the two contact portions and protrudes in outward direction of the cabinet to be disposed apart from the first plate in the outward direction of the cabinet, and a second non-contact portion disposed apart from the second plate in the outward direction of the cabinet

BRIEF DESCRIPTION OF THE DRAWINGS

These and/or other aspects of the disclosure will become apparent and more readily appreciated from the following description of the embodiments, taken in conjunction with the accompanying drawings of which

DETAILED DESCRIPTION

Figure 1:
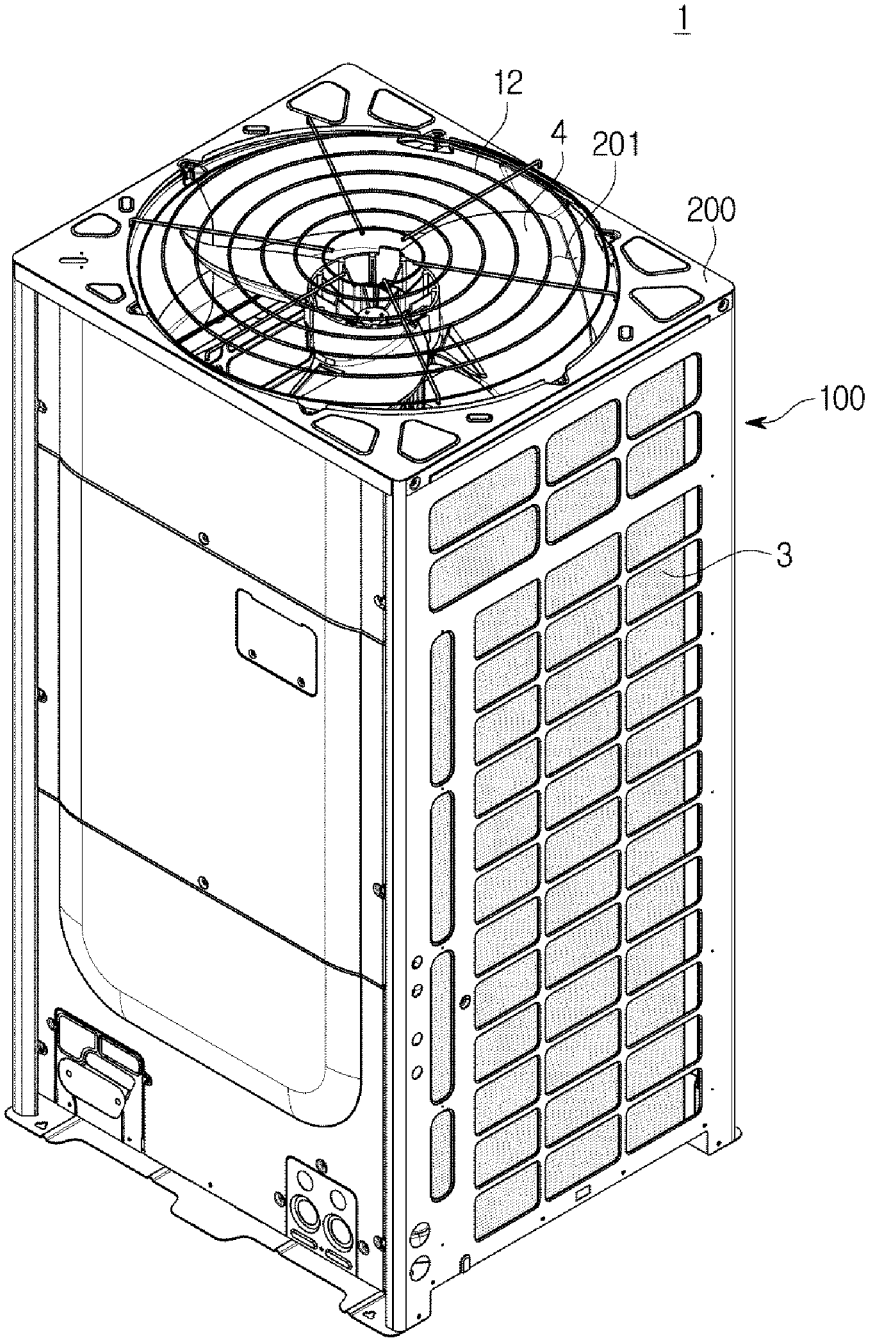
FIG. 1 is a perspective view of an outdoor unit of an air conditioner according to an embodiment of the present disclosure.

Embodiments described in this specification and configurations illustrated in drawings are only exemplary examples of the disclosed disclosure. The disclosure covers various modifications that may substitute the embodiments and drawings herein at the time of filing of this application.

In addition, the same reference numerals or symbols refer to parts or elements that perform substantially the same function.

In addition, terms used in the present specification are merely used to describe exemplary embodiments and are not intended to limit and/or restrict the embodiments. An expression used in the singular encompasses the expression of the plural unless it has a clearly different meaning in context. In the present specification, the terms such as "including," "having," and "comprising" are intended to indicate the presence of the features, numbers, steps, actions, elements, parts, or combinations thereof disclosed in the specification, and are not intended to preclude the possibility that one or more other features, numbers, steps, actions, elements, parts, or combinations thereof may be present or added.

In addition, it should be understood that although the terms "first," "second," etc. may be used herein to describe various elements, the elements should not be limited by these terms. These terms are only used to distinguish one element from another. For example, a first element could be termed a second element, and, similarly, a second element could be termed a first element without departing from the scope of the present disclosure. As used herein, the term "and/or" includes any and all combinations of one or more of the associated listed items.

Hereinafter, the upper, upward, lower, and downward used in the following description are defined with respect to the outdoor unit of the air conditioner 1 shown in FIG. 1.

And the front and forward used in the following description refer to a direction a front cabinet 110 of the outdoor unit of the air conditioner 1 shown in FIG. 1 faces, and rear and backward refer to a direction a rear cabinet 120 of the outdoor unit of the air conditioner 1 not shown in FIG. 1 faces.

Hereinafter, embodiments of the present disclosure will be described with reference to the accompanying drawings in detail.

Figure 2:
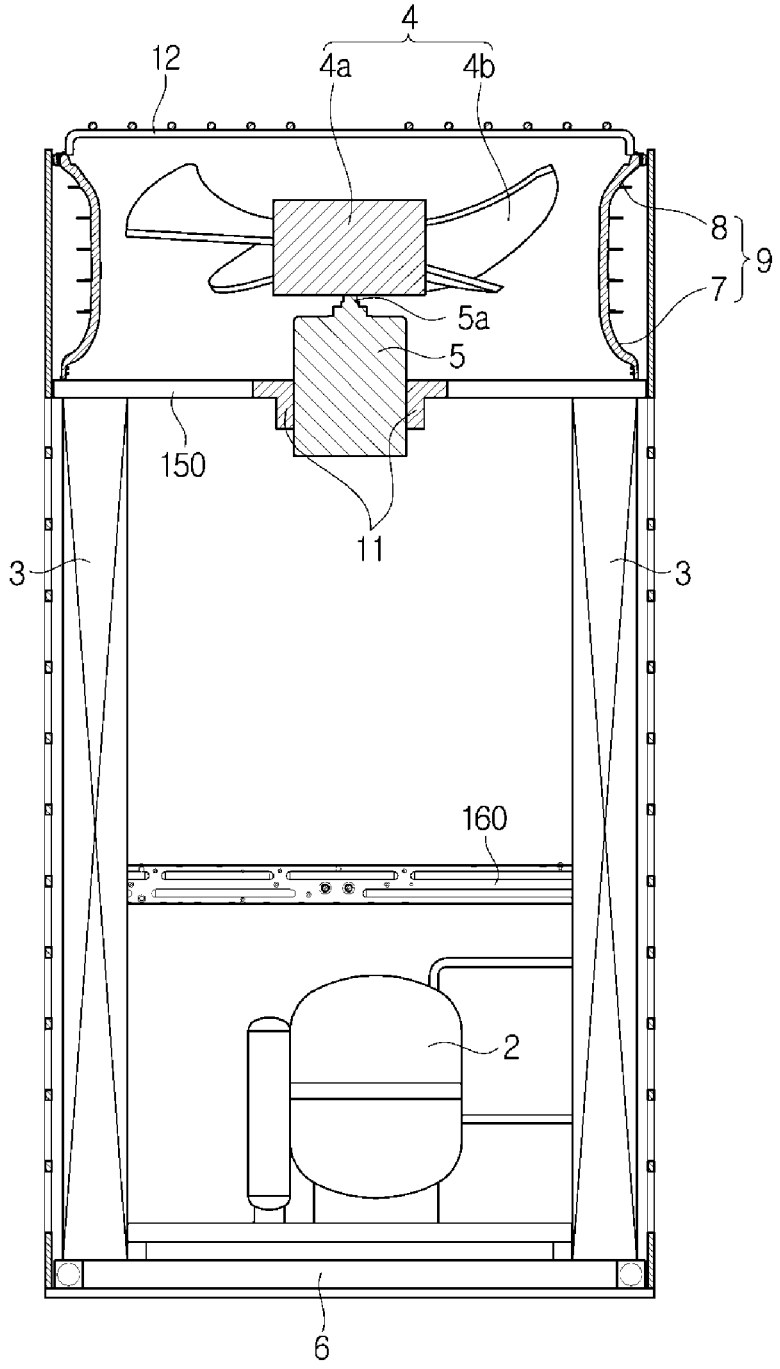
FIG. 2 is a cross-sectional view of an outdoor unit of an air conditioner according to an embodiment of the present disclosure.
Figure 3:
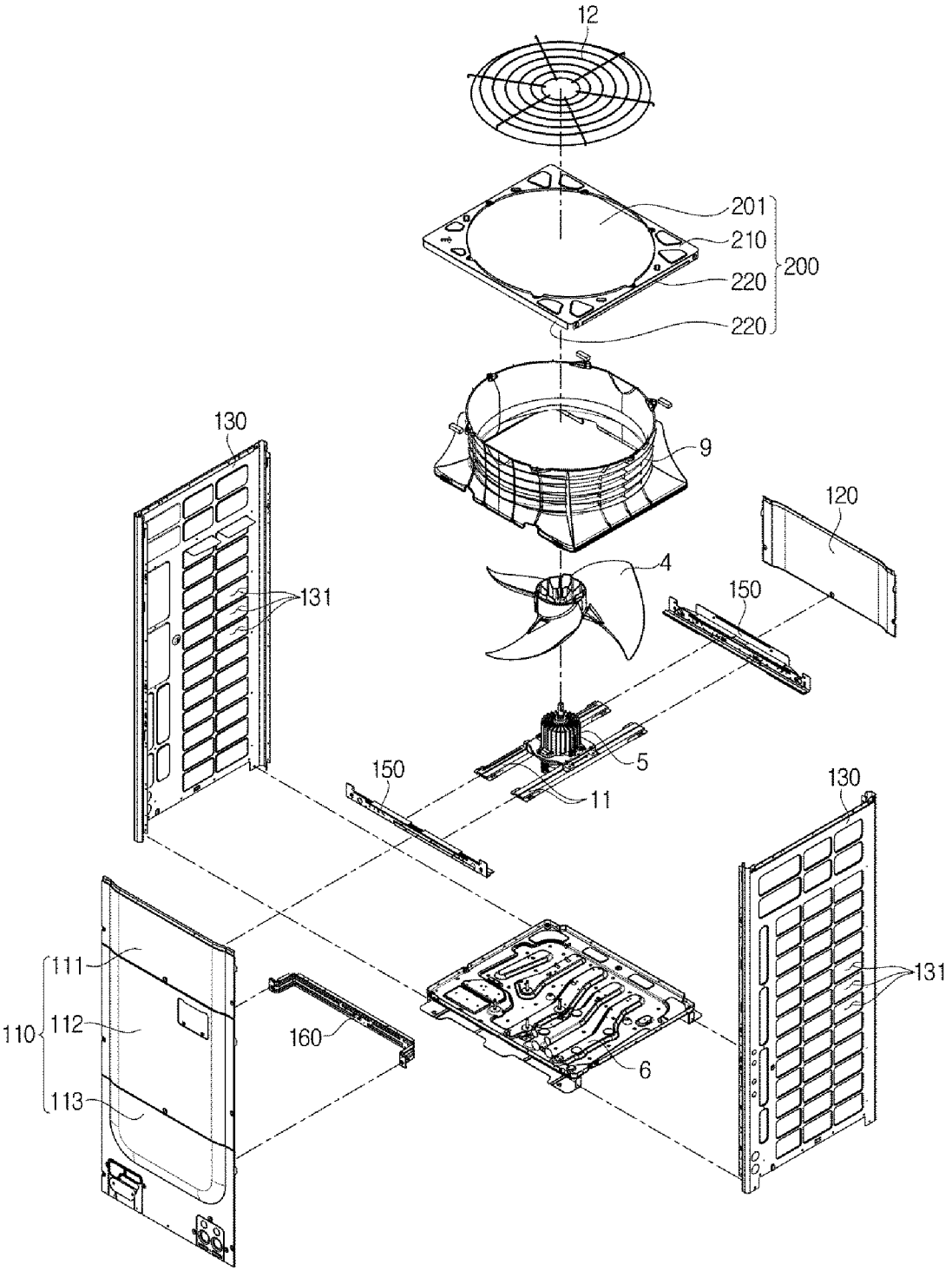
FIG. 3 is an exploded perspective view of a part of an outdoor unit of an air conditioner according to an embodiment of the present disclosure.

As shown in FIGS. 1 to 3, the outdoor unit of the air conditioner 1 (hereinafter, the outdoor unit 1) may include a cabinet 100 forming an outer appearance and having four sides, a compressor 2 disposed inside the cabinet 100 for compressing refrigerant, a heat exchanger 3 for exchanging heat with outdoor air, a blower 4 for allowing outdoor air to pass through the outdoor unit 1 and exchange heat with the outdoor heat exchanger 3, and a drive motor 5 for rotating the blower 4, (in FIG. 3, the configuration of the compressor 2 and the heat exchanger 3 are not shown for convenience of explanation).

The blower 4 has a hub portion 4*a* with a shaft 5*a* of the drive motor 5 installed at the center of the hub portion 4*a* to receive rotational force from the drive motor 5, and a plurality of wing portions 4*b* radially extending from the hub portion 4*a* and spaced from one another around the hub portion 4*a*.

The outdoor unit 1 may include the blower 4, a blower cover 200 covering the blower 4 and the cabinet 10, and a base member 6 disposed at the bottom of the cabinet 100 and having the compressor 2 seated thereon.

The cabinet 100 includes a front cabinet 110 disposed on the front surface of the outdoor unit 1, a rear cabinet 120 disposed on the rear surface, and a pair of side cabinets 130 disposed on either side of the cabinet 100, which are perpendicular to the front cabinet 110 and rear cabinet 120. The side cabinet 130 and the front cabinet 110 may be referred to as a first plate 130 and a second plate 110, respectively.

Since the pair of side cabinets 130 has a symmetrical structure, only one of the pair of side cabinets 130 will be described in the following description. However, the terms 'a (the) pair of side cabinets' and 'a (the) side cabinet' will both be denoted by the same reference numeral, 130.

The blower cover 200 may include an upper surface 210 provided with a discharge port 201, through which air that has exchanged heat with the heat exchanger 3 by the blower 4 is discharged, and an extension 220 extending downward from the rim of the upper surface 210.

The blower 4 may be disposed in the upper part of the cabinet 100. The outdoor unit 1 further include a tub-shaped molded object 9, which includes a bell mouth 7 for guiding air to the blower 4 and a diffuser portion 8 for guiding the air from the blower 4 to the discharge port 201 arranged outside the blower 4 in the radial direction.

The heat exchanger 3 may be disposed on inner sides of the pair of side cabinets 130 and the rear cabinet 120. Accordingly, the side cabinet 130 may include a suction port 131 for sucking air into the outdoor unit 1 to exchange heat between the air and the heat exchanger 3.

Unlike the front cabinet 110 and the side cabinet 130, the rear cabinet 120 is formed to be shorter than the front cabinet 110 and the side cabinet 130 in the vertical direction and may include an opening (not shown) formed between a lower side of the rear cabinet 120 and the side cabinet 130. Air is introduced into the outdoor unit 1 through the suction port 131 and the opening, exchanges heat with the heat exchanger 3 and is then discharged through the discharge port 201 arranged in an upper part of the outdoor unit 1 to the outside of the outdoor unit 1 of the air conditioner.

The front cabinet 110 may be separated into a front upper cabinet 111, a front middle cabinet 112, and a front lower cabinet 113. In other words, the front cabinet 110 may be made up with three parts 111, 112, and 113. However, the front cabinet 110 is not limited thereto, but may be formed in one piece.

The rear cabinet 120 may have a size corresponding to a size of the front upper cabinet 111. The rear cabinet 120 and the front cabinet 110 may extend downward from a side where the blower cover 200 is disposed. The length in the vertical direction of the rear cabinet 120 may be extended as much as the length of the front upper cabinet 11.

However, the rear cabinet 120 is not limited thereto, but may extend down from the front upper cabinet 111 to correspond to the entire length of the front cabinet 100.

An additional discharge port may be provided so that external air may flow to the heat exchanger 3 if the rear cabinet 120 is extended to correspond to the entire vertical length of the front cabinet 110

A pair of first frames 150 may be disposed inside the front cabinet 110 and the rear cabinet 120. Specifically, the pair of first frames 150 may be disposed on the lower side of the front upper cabinet 111 and the lower side of the rear cabinet 120. A second frame 160 may be disposed inside the front cabinet 110. Specifically, the second frame 160 may be disposed on the lower side of the front middle cabinet 112.

The lower side of the front upper cabinet 111 and the lower side of the rear cabinet 120 may be coupled together by the pair of first frames 150 and a coupling member 190 such as a screw or the. This will be described in detail later.

There may be brackets 11 orthogonally arranged between the pair of first frames 150. The pair of first frames 150 may be coupled to the brackets 11. The motor 5 and the blower 4 may be coupled to the brackets 11 so that the blower 4 may be disposed in the upper part of the cabinet 100.

The tub-shaped molded object 9 may be coupled to the inside of the upper surface 210 of the blower cover 200. Furthermore, a fan guard 12 for protecting the discharge port 201 may be provided above the upper surface 210.

The second frame 160 is coupled with the front middle cabinet 112 to improve the rigidity of the front cabinet 110 and to support a control box (not shown) provided inside the cabinet 100 between the first frame 150 and the second frame 160.

Hereinafter, the cabinet 100 and the structure of combining the cabinet 100 and the blower cover will be described in detail.

The outdoor unit 1 of air conditioner may have vibration due to the blower 4 and the air discharged by the blower 4, and the vibration makes the entire outdoor unit 1 shake, which might develop to damaging the components or making too much noise Since the container-shaped molded object 9 including the diffuser portion 8 for guiding air to be discharged as described above is coupled to the blower cover 200, heavy vibration is generated in the blower cover 200 due to the air being discharged, and the vibration may be transmitted to the cabinet 100 through the blower cover 200, shaking the entire outdoor unit 1.

In order to minimize the transmission of the vibration generated in the blower cover 200 to the cabinet 100, the conventional outdoor unit of air conditioner has increased engaging spots where the blower cover 200 and the cabinet 100 are engaged or have a lot of additional vibration-proof materials placed between the blower cover 200 and the cabinet 100 to secure the rigidity of the blower cover 200 and the cabinet 100.

As the number of engaging spots increases, the number of coupling members for engaging the blower cover 200 and the cabinet 100 and the number of the vibration-proof materials increase as well, which leads to an increase of the number of entire components of the outdoor unit 1. Even with the increased engaging spots to secure substantial rigidity, the vibration generated in the blower cover 200 is still transmitted to the cabinet 100 through the increased engaging spots without a significant drop off.

On the contrary, the outdoor unit 1 in accordance with an embodiment of the present disclosure may reduce transmission of the vibration to the cabinet 100 from the blower cover 200 by securing as large a non-contact area between the blower cover 200 and the cabinet 100 as possible while minimizing the number of the engaging spots where the blower cover 200 and the cabinet 100 are coupled.

Figure 4:
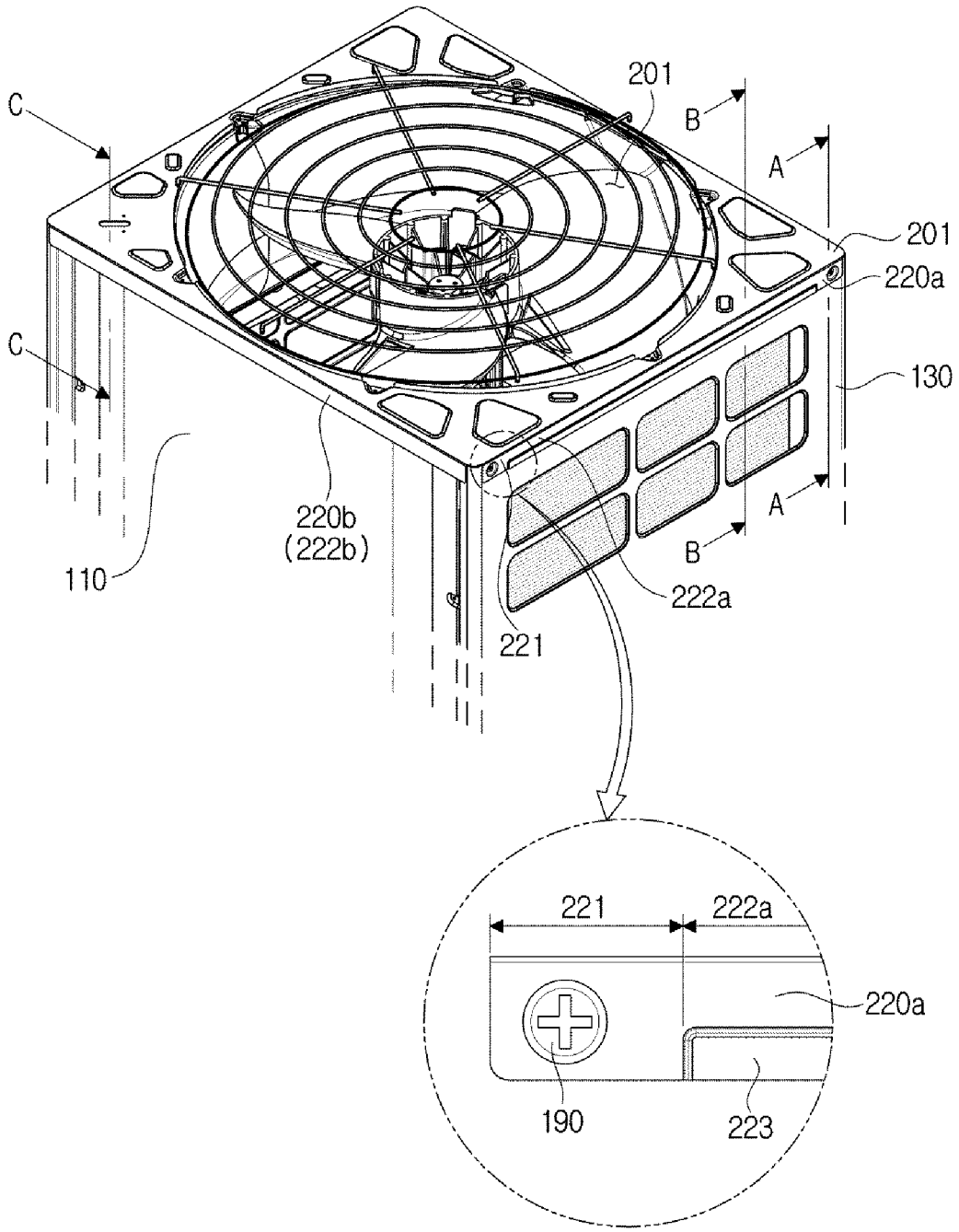
FIG. 4 is a perspective view of part of the configuration of an outdoor unit of an air conditioner according to an embodiment of the present disclosure.

As shown in FIG. 4, the blower cover 200 includes extensions 220 extending down from the four side edges of the upper surface 210. The extensions 220 may be formed to cover the tops of the front cabinet 110, rear cabinet 120, and side cabinet 130.

In detail, the extensions 220 may be disposed outside the cabinet 100 and extend down from the upper surface 210, so that at least parts of the upper portions of the cabinets 110, 120 and 130 are covered.

The upper surface 210 of the blower cover 200 may be disposed above and separated from the cabinet 100 in the vertical direction. That is, as the extensions 220 are coupled to the outside of the cabinet 100, the upper surface 210 is not supported directly by the cabinet 100, which prevents the vibration from being directly transmitted to the cabinet 100 through the upper surface 210.

As the extensions 220 may be disposed to cover the upper portion of the cabinet 100 as described above, it may overlap the outside of the cabinet from a predetermined height. The extensions 220 may be coupled to the cabinet 100 from the height at which the extensions 220 starts to overlap the cabinet 100, so that the blower cover 200 may be supported on the cabinet 100. Therefore, the vibration generated at the blower cover 200 may be transmitted to the cabinet 100 via the extensions 220.

In other words, the blower cover 200 does not contact or is supported by the cabinet 100 in the vertical direction, but may be coupled to the cabinet 100 on the side of the cabinet 100 or in the lateral direction of the cabinet 100. Therefore, the upper portion of the outer surface of the cabinet 100 may have an area in which to be coupled or not coupled but overlap with the blower cover 200.

Figure 5:
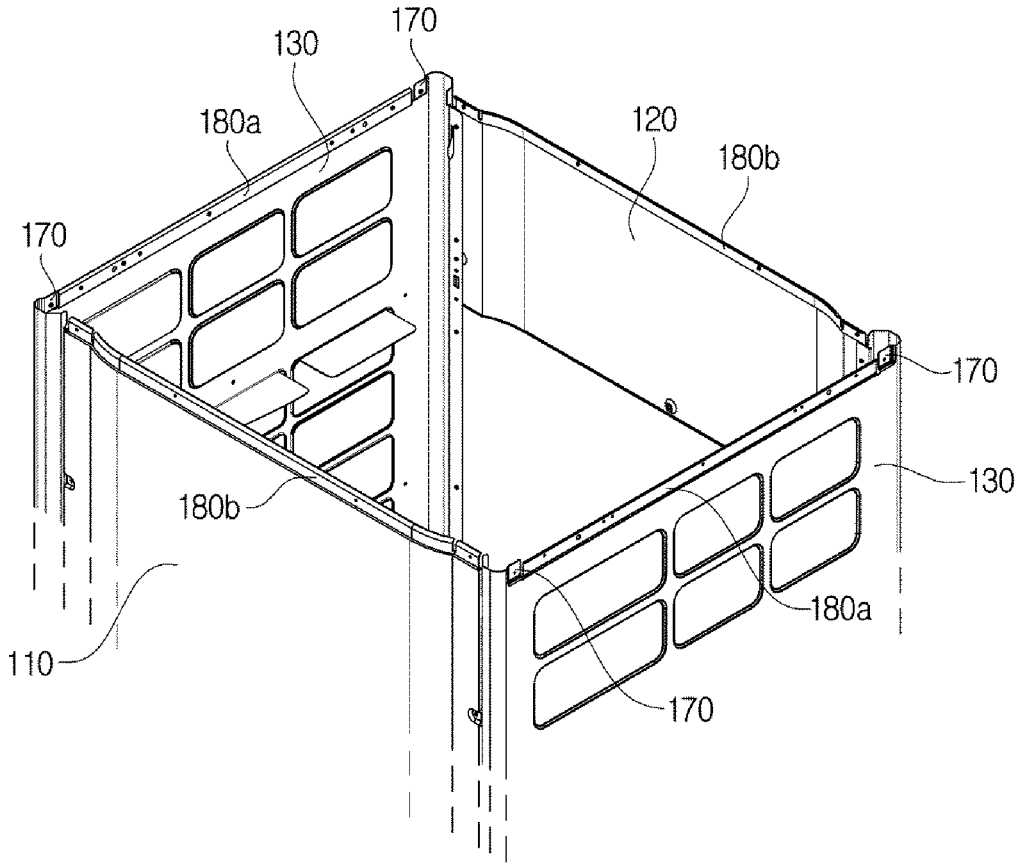
FIG. 5 is a perspective view of an upper portion of a cabinet of an outdoor unit of an air conditioner according to an embodiment of the present disclosure.

In detail, the blower cover 200 and the cabinet 100 secure a non-contact area between them to prevent the vibration generated in the blower cover 200 from being transmitted to the cabinet 100. As shown in FIG. 5, the cabinet 100 may include a contact area 170 in which to contact the blower cover 200 and a non-contact area 180 in which to not contact the blower cover 200.

The non-contact area 180 is disposed on the entire upper portion of the front cabinet 110 and rear cabinet 120 and the contact area 170 and a non-contact area 180 may be disposed on the upper side of the side cabinet 130.

Since the front cabinet 110 and the rear cabinet 120 are disposed symmetrically with respect to the blower cover 200, the structure in which the rear cabinet 120 is disposed is the same as the structure in which the front cabinet 110 is disposed, so the description thereof will be omitted.

The contact area 170 may include a coupling portion 191 for engaging the blower cover 200 and the side cabinet 130. That is, the coupling portion 191, which may be coupled to the blower cover 200, may be disposed on the upper side of the side cabinet 130.

In detail, two contact areas 170 are disposed on both sides of the upper side of the side cabinet 130 and the respective coupling portions 191 are disposed inside the two contact areas 170.

The coupling portion 191 may be engaged with the blower cover 200 by e.g., screwing a coupling member 190. Therefore, the coupling portion 191 may be provided in the shape of a coupling hole, through which a coupling member 190 passes.

The blower cover 200 may be coupled to four engaging portions 191 provided on both sides of the upper side of the pair of side cabinets 130.

In the conventional case, the blower cover is coupled to all four sides of the cabinet, and at least two coupling portions are provided in each of the four sides to be coupled to the side of the blower cover. On the contrary, according to the embodiment of the present disclosure the blower cover 200 is coupled onto a pair of facing sides of the cabinet 100 at the ends of the sides, minimizing the coupling portions 191 and thus minimizing a path, along which the vibration generated from the blower cover 200 is transmitted to the cabinet 100.

That is, a pair of the other facing sides of the cabinet 110, 120 and blower cover 200 are not coupled to each other, so the vibration generated in the blower cover 200 is not directly transmitted to the pair of the other facing sides of the cabinet 110, 120 from blower cover 200.

In an embodiment of the present disclosure, the coupling portions 191 are not disposed in the front cabinet 110 and the rear cabinet 120 facing each other, i.e., the blower cover 200 does not contact the front cabinet 110 and the rear cabinet 120, and the vibration generated in the blower cover 200 is not transmitted to the front cabinet 110 and the rear cabinet 120.

Each of the pair of side cabinets 130 has two coupling portions 191, and thus the vibration generated in the blower cover 200 may be transmitted to the pair of side cabinets 130 through the coupling portions 191. In this case, however, the transmission of the vibration generated in the blower cover 200 to the pair of side cabinets 130 may be minimized.

In other words, since the non-contact area 180 disposed on the upper sides of the front cabinet 110 and the rear cabinet 120 facing each other does not contact the blow cover 200, the upper sides of the front cabinet 110 and the rear cabinet 120 are not in contact with the blower cover 200. And since the pair of side cabinets 130 may have the contact area 170, the vibration may be transmitted to the pair of side cabinets 130 through the contact area 170.

The extensions 220 of the blower cover 200 may include a contact portion 221 provided to correspond to the contact area 170 and a non-contact portion 222 provided corresponding to the non-contact area 180.

The contact portion 221 is an area to face the outside of the cabinet 100 and the outside of the contact area 170 when the blower cover 200 is coupled with the cabinet 100. The non-contact portion 222 is an area to face the outside of the cabinet 100 and the outside of the non-contact area 180 when the blower cover 200 is coupled with the cabinet 100.

The contact portion 221 may be disposed in contact with the contact area 170 when the blower cover 200 is coupled to the cabinet 100, and the non-contact portion 222 may be disposed to be separated from the non-contact area 180 in the outward direction of the cabinet 100.

The non-contact portion 222 may include a first non-contact portion **222*a* provided to correspond to a first non-contact area 180*a* disposed in the side cabinet 130, a second non-contact portion 222*b* provided to correspond to a second non-contact area 180*b* disposed in the front cabinet 110**.

The first non-contact portion **222*a* may include a bead 223 protruding in the outer direction from the cabinet 100 to prevent the first non-contact portion 222*a* from coming into contact with the first non-contact area 180*a***.

In the case of the second non-contact portion **222*b*, there is no area in which the front cabinet 110 and the extension 220 are in contact with each other, and the front extension 220*b* corresponding to the front cabinet 110 as a whole may be disposed on the outer side of the cabinet 100 rather than the front cabinet 110** as a whole.

Accordingly, even if the front extension **220*b* vertically extends down from the upper surface 210, the second non-contact area 180*b* of the front cabinet 110 is not in contact with the upper surface 210. Thus, there is no need to dispose a separate protruding bead 223. However, a bead 223 provided to secure rigidity of the front extension 220*b*** may be disposed.

Since a side extension **220*a* may include a through hole 224 coupled with the coupling portion 191 by screwing, and the contact portion 221 is provided to be in contact with the contact area 170, the side extension 220*a* may not be disposed to be separated from the side cabinet 130 outside the cabinet 100**.

To prevent the first non-contact portion **222*a* from contacting the first non-contact area 180*a*, the first non-contact portion 222*a* may include the bead 223 projecting in the direction to the outside of the first non-contact area and the cabinet 100**.

The first non-contact portion 222*a* protrudes in the direction to the outside of the cabinet 100 by the bead 223, so that the first non-contact area 180*a* and the first non-contact portion 222*a* may be arranged to be separated outside the cabinet 100.

Therefore, the first non-contact portion 222*a* does not contact the first non-contact area 180*a* of the side cabinet 130, and thus, may not receive the vibration directly through the blower cover 200.

Figure 6:
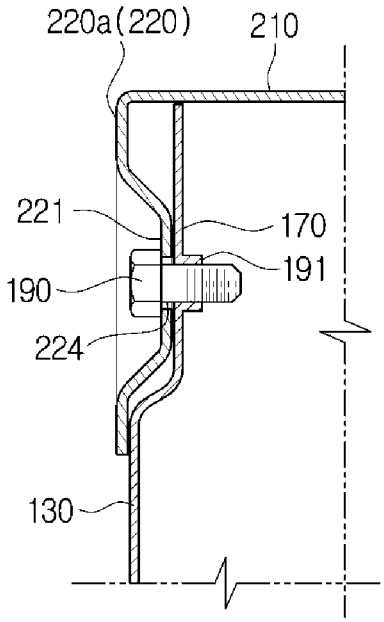
FIG. 6 is a cross-sectional view of the AA portion of FIG. 4.

Refer to FIG. 6 showing a cross-section of the AA side of the side extension 220*a* where the contact area 170 and the contact portion 221 face each other, the contact area 170 and the contact portion 221 are provided in contact with each other for the blower cover 200 and the cabinet 100 to be coupled with each other by the coupling member passing through the through hole 224 and the coupling portion 191.

As shown in FIG. 6, the contact portion 221 adjacent to the through hole 224 may be formed to be concave toward the cabinet 100 and the contact area 170 may be formed to be concave toward the inside of the cabinet 100 along the contact portion 221. However, contact portion 221 may vertically extend down from the upper surface 210 and the contact area 170 may vertically extend upward without having concaved portion.

Figure 7:
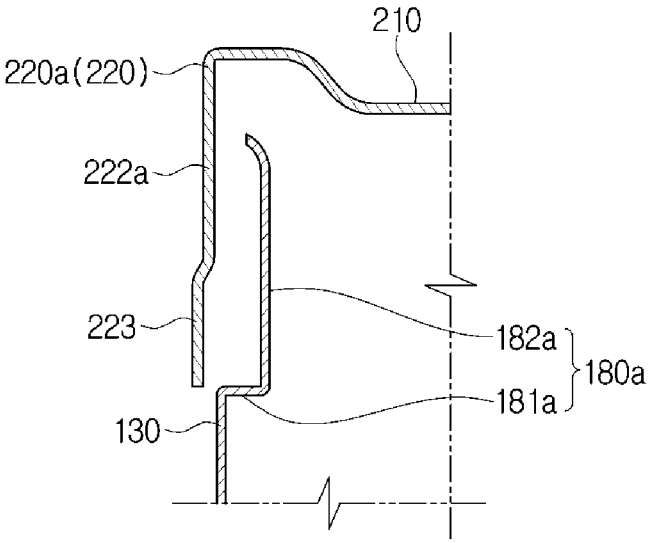
FIG. 7 is a cross-sectional view of the BB portion of FIG. 4.

Referring to FIG. 7 showing a cross-section of the BB side where the first non-contact area 180*a* and the first non-contact portion 222*a* face each other on the side extension 220*a*, the first non-contact portion 222*a* may be located relatively far from the cabinet 100 due to the bead 223 as compared to the contact portion 221.

Accordingly, the first non-contact portion 222*a* and the first non-contact area 180*a* may be spaced apart from each other in the outward direction of the cabinet 100. Therefore, the vibration generated in the blower cover 200 is not transmitted to the first non-contact area 180*a*.

However, if the vibration is transmitted from the blower cover 200 to the cabinet 100, shaking the cabinet 100, the first noncontact portion 222*a* and the first non-contact area 180*a* may come into contact with each other.

Thus, in order to increase the distance between the first non-contact portion 222*a* and the first non-contact area 180*a*, the first non-contact area 180*a* may include a bent portion 181*a* bending and extending in the inward direction of the cabinet 100 and an inner side portion 182*a* disposed farther inside the cabinet 100 than the side cabinet 130 by extending upward from the bent portion 181*a*.

The inner side portion 182*a* faces the first non-contact portion 222*a* and might contact the first non-contact portion 222*a* if the cabinet 100 shakes. However, since the inner side portion 182*a* may be bent in an inward direction of the cabinet 100 by the bent portion 181*a*, a separation distance between the first non-contact portion 222*a* and the inner side portion 182*a* increases, and thus the inner side portion 182*a* may not contact the first non-contact portion 222*a* even if the cabinet 100 shakes.

Figure 8:
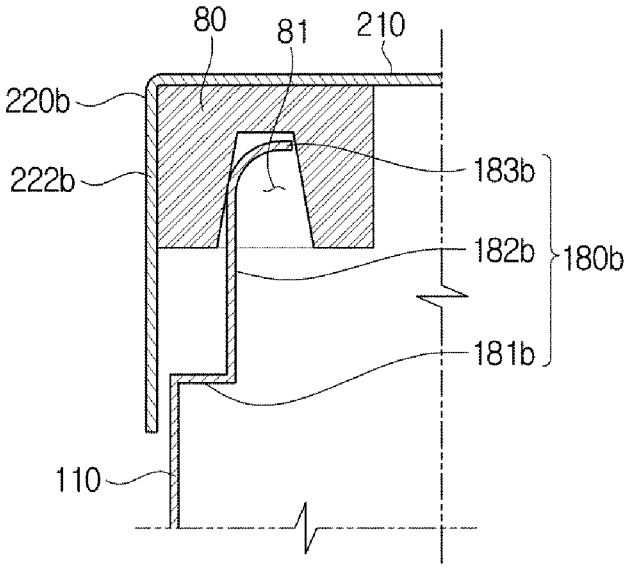
FIG. 8 is a cross-sectional view of the CC portion of FIG. 4.

Referring to FIG. 8 showing a cross-section of the CC side where the second non-contact area 180*b* and the second non-contact portion 222*b* face each other on the front extension 220*b*, second non-contact portion 222*b* may be spaced apart from the second non-contact area 180*b* in the outward direction of the cabinet 100.

The entire front cabinet 110 has the second non-contact area 180*b* disposed on the upper portion of the front cabinet 110, and may not be in contact with the blower cover 200. Therefore, the vibration generated in the blower cover 200 is not directly transmitted to the front cabinet 110.

However, if the vibration is transmitted from the blower cover 200 to the cabinet 100 or the vibration occurs in the blower cover 200, the second non-contact portion 222*b* and the second non-contact area 180*b* may sometimes be in contact with each other.

Therefore, in order to increase the distance between the second non-contact portion 222*b* and the second non-contact area 180*b*, the second non-contact area 180*b* includes a bent portion 181*b* bending and extending in the inward direction of the cabinet 100 and an inner side portion 182*b* disposed farther inside the cabinet 100 than the side cabinet 130 by extending upward from the bent portion 181*b*.

The inner side portion 182*b* faces the second non-contact portion 222*b* and might contact the second non-contact portion 222*b* if the cabinet 100 shakes. However, since the inner side portion 182*b* may be bent in an inward direction of the cabinet 100 by the bent portion 181*b*, a separation distance between the second non-contact portion 222*b* and the inner side portion 182*b* increases, and thus the inner side portion 182*b* may not contact the second non-contact portion 222*b* even if the cabinet 100 shakes.

However, if the front extension 220*b* has a part bending downward formed with a large distance from the front cabinet 110 in the outward direction of the cabinet 100, the front extension 220*b* may extend upward in the front cabinet 110 without the above-described bent portion 181*b* and the inside portion 182*b*.

The front extension 220*b* may be bent with a large distance in the outward direction of the cabinet 100 because the contact portion 221 is not disposed on the front extension 220*b* unlike the side extension 220*a*.

Since the front cabinet 110 does not include the coupling portion 191 to be coupled with the blower cover 200, if the cabinet 100 shakes, a fixing force of the front cabinet 110 in the vertical direction is weaker than that of the side cabinet 130, so the vibration may occur in the vertical direction in the front cabinet 110.

To prevent this, a vibration-proof member 80 for preventing shaking of the front cabinet 110 may be provided between the inner side of the upper surface 210 and the upper side of the front cabinet 110. The vibration-proof member 80 may be provided with an insertion groove 81, into which the upper end of the front cabinet 110 is inserted. The upper end of the front cabinet 110 may be fixed by the vibration-proof member 80 while being inserted into the insertion groove 81. Accordingly, even if the front cabinet 110 is shaken in the vertical direction, the vibration may be reduced by the vibration-proof member 80.

The vibration-proof member 80 may include a material such as rubber having an anti-vibration property. The vibration-proof member 80 may be disposed in contact with the inner side of the upper surface 210 of the blower cover 200.

Hereinafter, an assembling structure of the cabinet 100 will be described.

Figure 9:
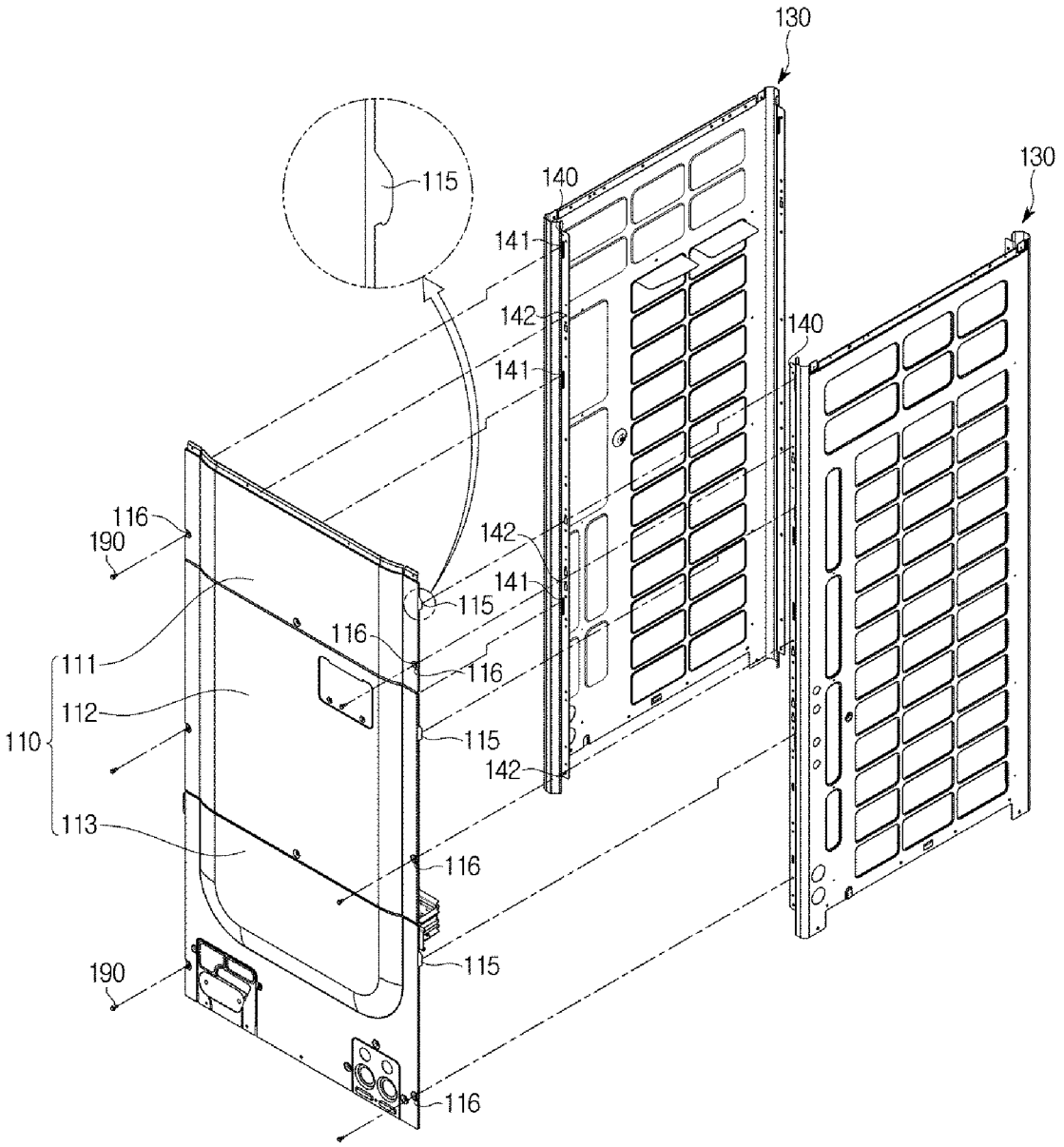
FIG. 9 is an exploded perspective view of part of the configuration of an outdoor unit of an air conditioner according an embodiment of the present disclosure.

As shown in FIG. 9, the front cabinet 110 may be hooked to the side cabinet 130. Since the rear cabinet 120 is coupled to the side cabinet 130 in the same manner as does the front cabinet 110, description of the rear cabinet 120 will be omitted below.

A hook 115 protruding toward the inside of the cabinet 100 is provided on the upper side of the inner surface of the front cabinet 110 and may be hooked to the side cabinet 130.

The front cabinet 110 is composed of the front upper cabinet 111, the front middle cabinet 112 and the front lower cabinet 113, as described above. The front upper cabinet 111, the front middle cabinet 112, and the lower cabinet 113 are all hooked by the hooks 115 in the same manner. So, for convenience of explanation, the front upper, front middle, and front lower cabinets 111, 112, and 113 will be collectively described as the front cabinet 110.

Also, as described above, the front cabinet 110 is not limited thereto, but may be in one piece. In this case, the front cabinet 110 may be hooked to the side cabinets 130 via two hooks 115 provided at either end of the upper side of the inner surface of the front cabinet 110.

The side cabinets 130 may each include a coupling surface 140 bent toward the inner surface of the front cabinet 110 and engaged with the inner surface of the front cabinet 110 (the side cabinets refer to a pair of side cabinets symmetrically disposed and coupled to the front cabinet in the same manner, so hereinafter, configuration of one side cabinet will be described for convenience of explanation).

The coupling surface 140 may bend in a direction substantially orthogonal to the side cabinet 130 so that the inner surface of the front cabinet 110 may be disposed adjacent to the coupling surface 140. The coupling surface 140 may have a hook groove 141, into which the hook 115 of the front cabinet 110 is hooked.

The front cabinet 110 may be coupled to the side cabinet 130 while the hook 115 is hooked into the hook groove 141, making the coupling surface 140 come into contact with the inner surface of the front cabinet 110.

Even when the front cabinet 110 is hooked to the coupling surface 140, the front cabinet 110 is not actually engaged with the coupling surface 140 and the hook 115 may be detached from the hook groove 141.

Thus, to couple the front cabinet 110 onto the coupling surface 140, a first coupling hole 116 may be formed on the lower side of the front upper cabinet 111, the front middle cabinet 112, and the front lower cabinet 113 to be coupled to the coupling surface 140 by the coupling member 190.

By screwing, the coupling member 190 may go through the first coupling hole 116 and may be coupled with a second coupling hole 142 formed in the coupling surface 140.

The second coupling hole 142 may be formed to correspond to a position where the first coupling hole 116 is formed, when the front cabinet 110 is hooked to the coupling surface 140, and may be coupled by the coupling member 190.

In the conventional case, the cabinet is assembled through screw coupling with coupling members, in which case all four sides of the cabinet are formed by the screw coupling with the coupling members, so the number of engaging spots increases, leading to an increase of configurations and processes.

Furthermore, even when the blower cover is coupled with the cabinet as described above, a large number of engaging spots are required, which also leads to an increase of configurations and processes. However, in the embodiment of the present disclosure, the number of engaging spots is reduced by limiting the coupling portions 191 to four, and the quantity of the engaging spots for assembling the outdoor unit 1 may be reduced by replacing the coupling member 190 with the hook 115, thereby reducing the number of the engaging spots for the coupling members 190.

Figure 10:
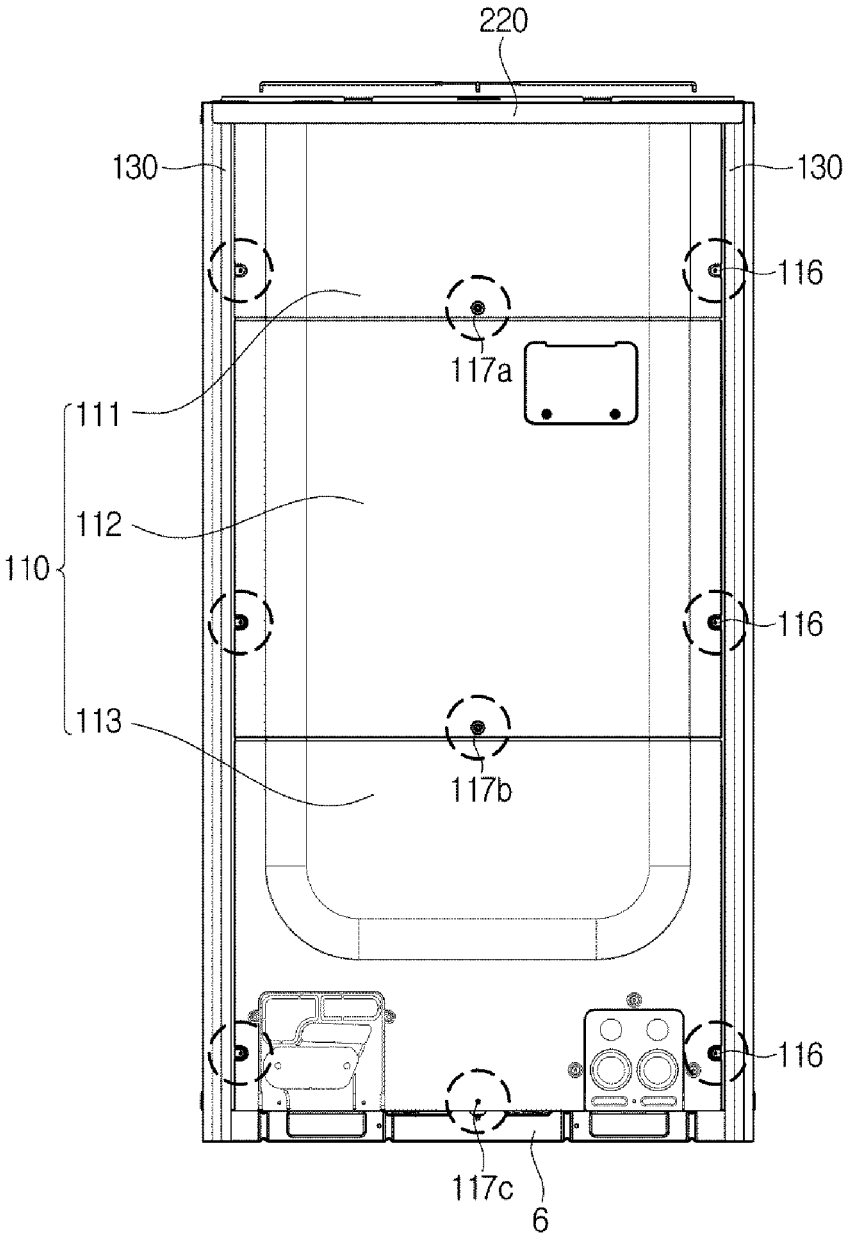
FIG. 10 is a front view of an outdoor unit of an air conditioner according to an embodiment of the present disclosure.

As shown in FIG. 10, the front cabinets 111, 112 and 113 may be combined into the front cabinet 110 with a total of nine engaging spots: six first coupling holes 116 to be coupled with the coupling surface 140 by the coupling member 190, a third coupling hole 117*a* formed to be coupled with the first frame 150 (see FIG. 3) to secure extra rigidity at the lower side of the front upper cabinet 111, a fourth coupling hole 117*b* formed to be engaged with the second frame 160 (see FIG. 3) to secure extra rigidity at the lower side of the front middle cabinet 112, and a fifth coupling hole 117*c* formed to be engaged with a base member 6 to secure extra rigidity at the lower side of the front lower cabinet 113

Figure 11:
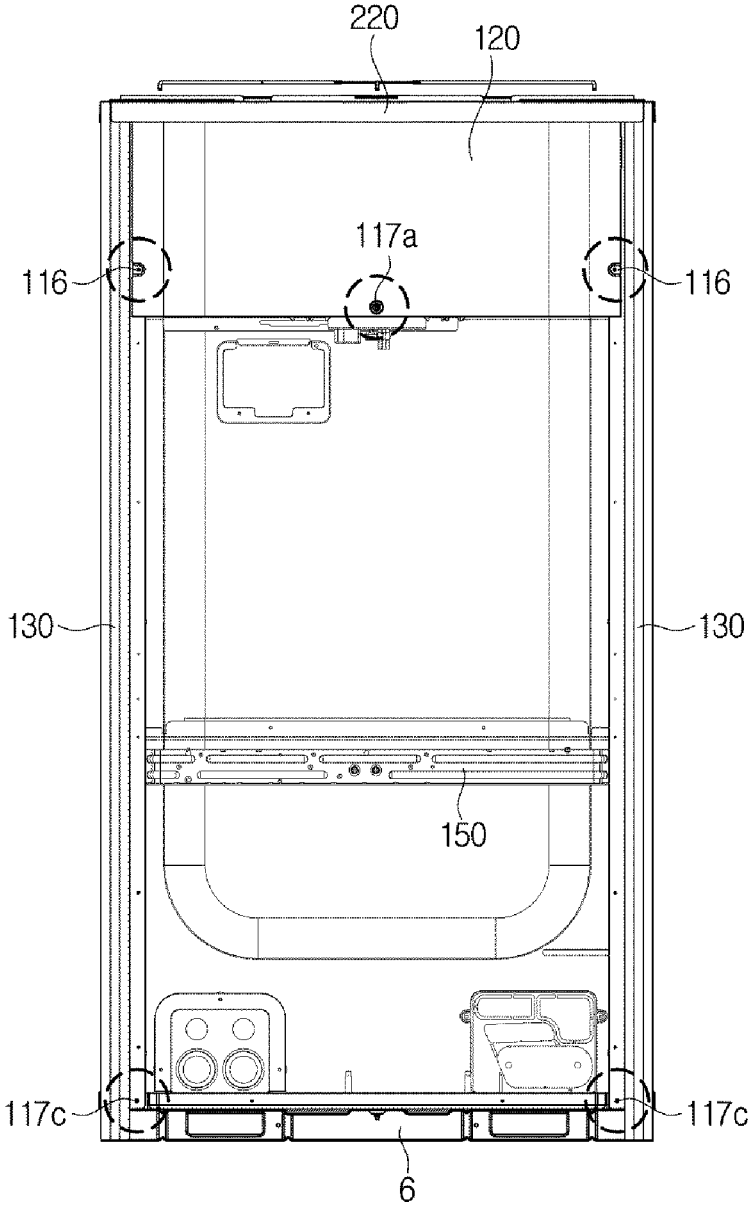
FIG. 11 is a rear view of an outdoor unit of an air conditioner according to an embodiment of the present disclosure.

As shown in FIG. 11, the rear cabinet 120 may be assembled with a total of five engaging spots: two first coupling holes 116 combined with the coupling surface 140 by the coupling members 190, one third coupling hole 117*a* formed on the lower side of the rear cabinet 120 to be coupled with the first frame 150 to secure extra rigidity, two fifth coupling holes 117*c* formed on the rear cabinet 120 for the pair of side frames 130 to be coupled with the base member 6.

Figure 12:
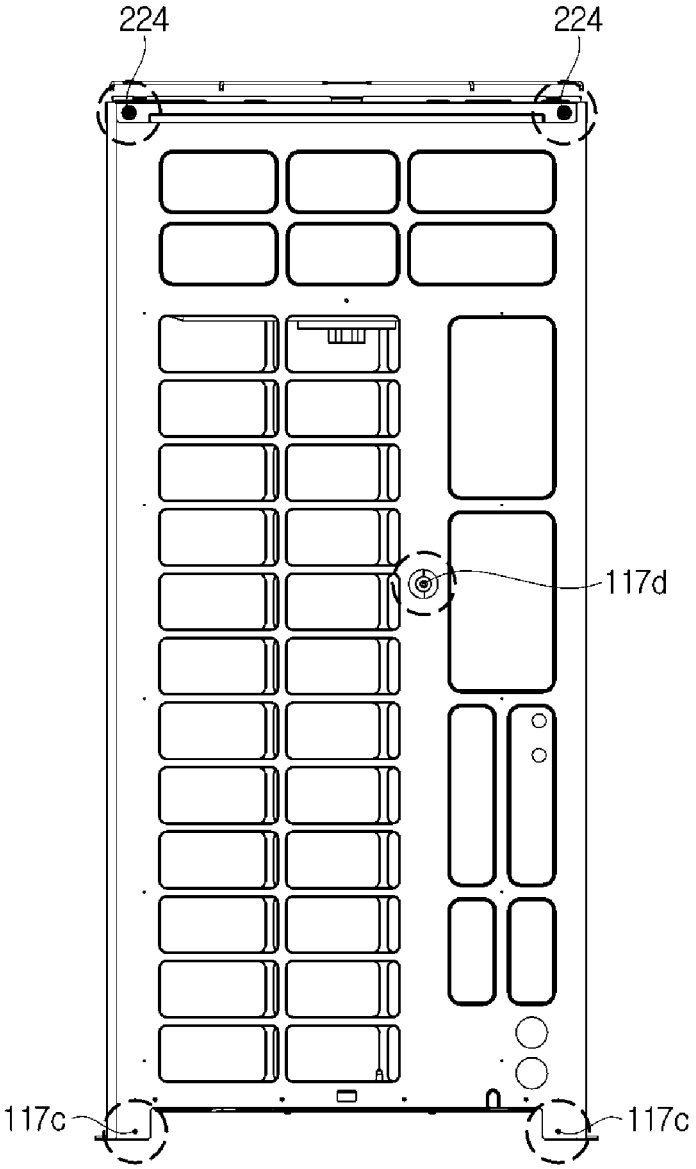
FIG. 12 is a side view of an outdoor unit of an air conditioner according to an embodiment of the present disclosure.

As shown in FIG. 12, a pair of side cabinets 130 may be assembled with a total of ten engaging spots: two through holes 224 formed to couple the blower cover 200 and the cabinet 100, two fifth coupling holes 117*c* formed for the lower side of the side cabinet 130 to be coupled with the base member 6, and one sixth coupling hole 117*d* formed on the middle of the side cabinet 130 to be coupled with the heat exchanger 3 to secure extra rigidity for each side cabinet The number of engaging spots shown in FIGS. 10 to 12 is the minimum number of engaging spots required for assembling the outdoor unit 1 according to the embodiment of the present disclosure, but is not limited thereto. For example, the outdoor unit 1 may be assembled with more engaging spots than shown in FIGS. 10 to 12.

Although it was described above that the blower cover 200 is coupled with the pair of the side cabinets 130, the blower cover 200 may be coupled to the front cabinet 110 and the rear cabinet 120 and may be coupled to the cabinet 100 without contacting the pair of side cabinets 130.

Also, at least three of the four sides of the cabinet (front cabinet 110, rear cabinet 120, and pair of side cabinets), for example, the pair of side cabinets 130 and the front cabinets 110 may be coupled to the blower cover 200 and may be coupled to the cabinet 100 without contacting the rear cabinet 120.

However, in a case that the blower cover 200 is coupled to at least one of the four sides of the cabinet (front cabinet 110, rear cabinet 120, and pair of side cabinets), it may be difficult to secure rigidity in coupling between the blower cover 200 and the cabinet 100. Therefore, it is preferable to have at least two of the four sides of the cabinet (front cabinet 110, rear cabinet 120, and pair of side cabinets), in particular, a pair of facing cabinets (the pair of side cabinets 130 or front cabinet 110 and rear cabinet 120) in coupling with the blower cover 200 as described above.

Hereinafter, an outdoor unit 1 according to another embodiment of the present disclosure will be described. Configurations of the outdoor unit 1 as will be described below are identical the outdoor unit 1 according to the previous embodiment of the present disclosure except for the configuration of the vibration-proof member, so the overlapping description will be omitted below.

The vibration-proof member 80 may be disposed on the inner side of the upper surface 210 of the blower cover 200, the inner side of the front extension 220*b*, and the upper side of the front cabinet 110. The vibration-proof member 80 may reduce occurrences of the vertical vibration of the front cabinet 110 by inserting the front cabinet 110 into the insertion groove 81 as described above.

With the vibration-proof member 80 located in contact with the inner side of the upper surface 210 and the inner side of the front extension 220*b*, vibration of the blower cover 200 is transmitted not directly but via the vibration-proof member 80 because the upper side of the front cabinet 110 is formed as the non-contact area 180*b* and does not contact the blower cover 200.

Figure 13:
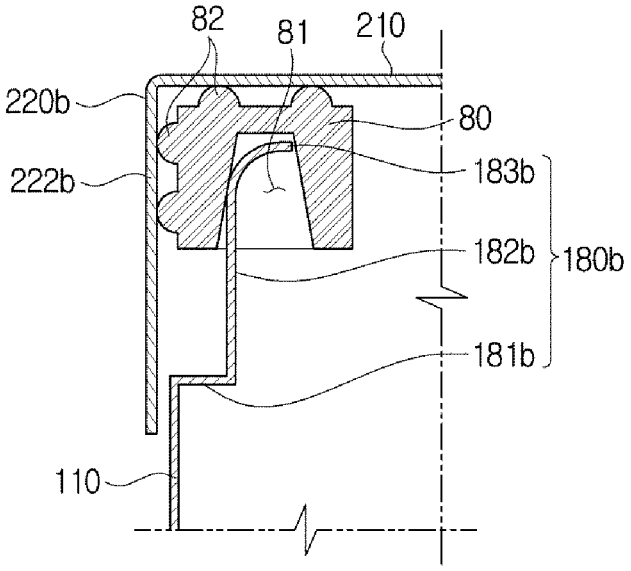
FIG. 13 is a cross-sectional view of a portion of an outdoor unit of an air conditioner according to another embodiment of the present disclosure.

As shown in FIG. 13, in order to minimize transmission of the vibration to the front cabinet 110 from the vibration-proof member 80, the vibration-proof member 80 may include vibration-proof protrusions 82 protruding toward the inner side of the upper surface 210 and the inner side of the front extension 220*b*.

The vibration-proof protrusions 82 prevent the main body of the vibration-proof member 80 from contacting the inner side of the upper surface 210 and the inner side of the front extension 220*b* but allowing themselves to contact the inner side of the upper surface 210 and the inner side of the front extension 220*b*, thereby reducing an amount of vibration transmitted to the vibration-proof member 80 through the inner side of the upper surface 210 and the inner side of the front extension 220*b*.

In other words, by reducing the contact area between the vibration-proof member 80 and the blower cover 200 through the vibration-proof protrusion 82, transmission of the vibration generated in the blower cover 200 to the vibration-proof member 80 may be minimized.

Hereinafter, an outdoor unit 1 according to yet another embodiment of the present disclosure will be described. Other configurations than those of the first auxiliary vibration-proof member 90 and the coupling surface 140 as will be described below are the same as the configurations of the outdoor unit of the air conditioner according to the previous embodiments of the present disclosure, so the overlapping description will be omitted below.

As described above, the front cabinet 110 is coupled to the engaging surface 140 when the hook 115 disposed on the inner surface of the front cabinet 110 is hooked into the hook groove 141 disposed on the engaging surface 140.

In this case, however, the hook 115 and the hook groove 141 are simply hooked together, so if the cabinet 100 is shaken, the hook may be disengaged from the hook groove 141 or the hook 115 may vibrate in the hook groove 141 and make noise.

Figure 14:
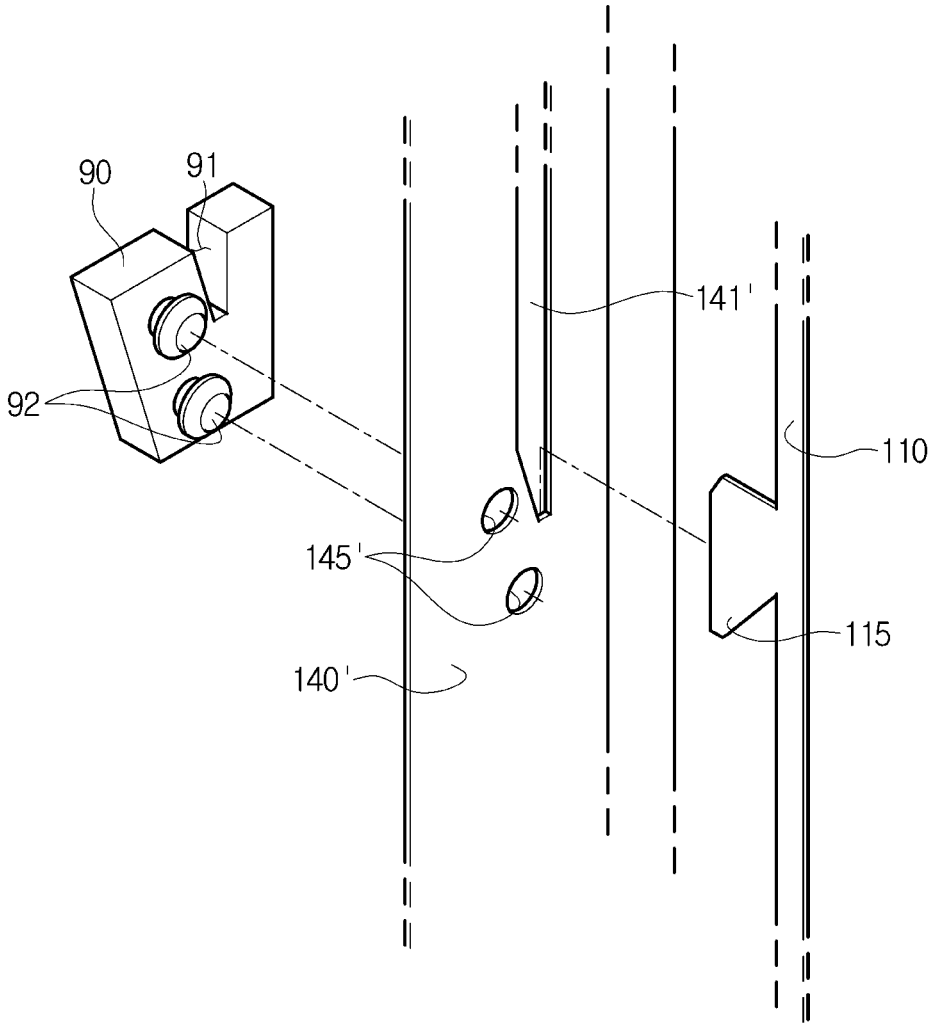
FIG. 14 is an exploded perspective view of part of the configuration of an outdoor unit of an air conditioner according to another embodiment of the present disclosure.
Figure 15:
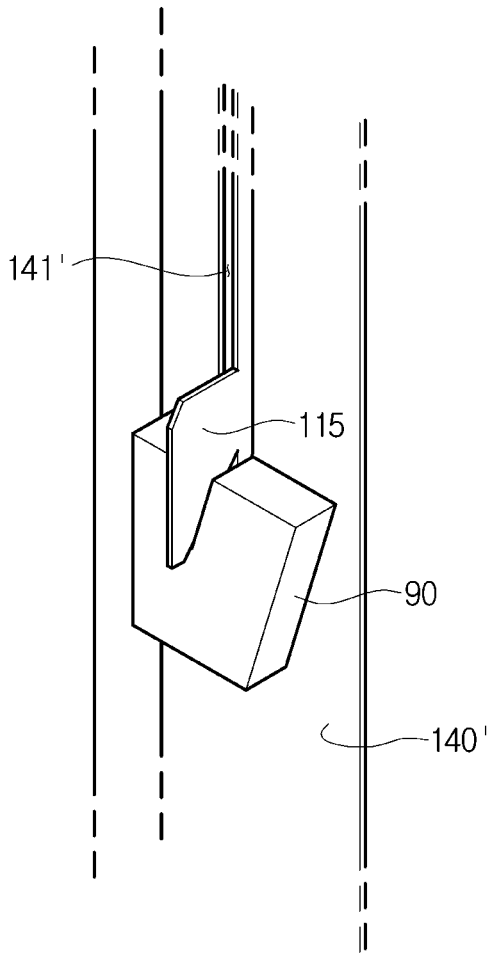
FIG. 15 is a rear view of part of the configuration of an outdoor unit of an air conditioner according to another embodiment of the present disclosure.

To prevent this, as shown in FIGS. 14 to 15, the outdoor unit 1 according to yet another embodiment of the present disclosure includes an auxiliary vibration-proof member 90 disposed between the hook 115 and a hook groove 141' to prevent vibration of the hook 115.

Wth the auxiliary vibration-proof member 90 including a vibration-resistant material disposed between the hook 115 and the hook groove 141', the vibration of the hook 115 may be absorbed by the auxiliary vibration-proof member 90, thereby preventing the hook 115 from vibrating inside the hook groove 141', and from falling out of the hook groove 141'.

The auxiliary vibration-proof member 90 may include an insertion groove 91 into which the hook 115 is inserted and a coupling protrusion 92 protruding toward the coupling surface 140' for the auxiliary vibration-proof member 90 to be engaged with the coupling surface 140'.

The coupling surface 140' may be provided with a protrusion hole 145' corresponding to the coupling protrusion 92 so that the coupling protrusion 92 may pass therethrough. When assembling the auxiliary vibration-proof member 90, the auxiliary vibration-proof member 90 is simply pressed toward the coupling surface 140' so that the coupling protrusion 92 penetrates the protrusion hole 145' and auxiliary vibration-proof member 90 may be coupled to the coupling surface 140'.

As shown in FIG. 14, two coupling protrusions 92 and two protrusion holes 145' are formed, but the present disclosure is not limited thereto, and more than two coupling protrusions may be used to prevent the auxiliary vibration-proof member 90 from being detached from the coupling surface 140'.

Hereinafter, an outdoor unit according to another embodiment of the present disclosure will be described. Other configurations than the configuration of the second auxiliary vibration-proof member 70 as will be described below are the same as the configurations of the outdoor unit of the air conditioner according to the previous embodiments of the present disclosure, so the overlapping description will be omitted below.

Figure 16:
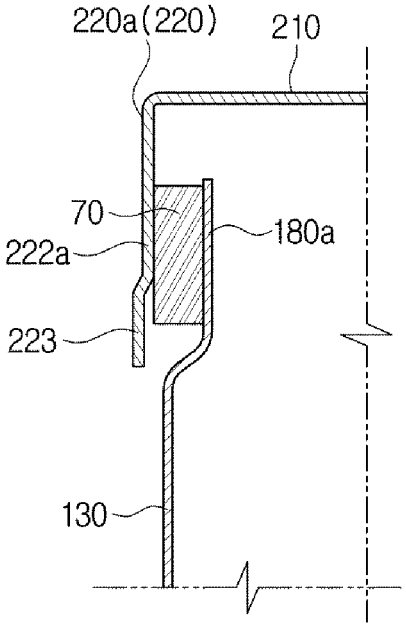
FIG. 16 is a cross-sectional view of part of the configuration of an outdoor unit of an air conditioner according to another embodiment of the present disclosure.

As shown in FIG. 16, the second auxiliary vibration-proof member 70 may be located in the gap between the first non-contact area 180*a* and the first non-contact portion 222*a*. When the gap between the first non-contact area 180*a* and the first non-contact portion 222*a* is narrow, the first non-contact area 180*a* and the first non-contact portion 222*a* may come into contact with each other due to the vibration of the cabinet 100 and the blower cover 200.

In this case, the vibration generated in the blower cover 200 may be transmitted through the first non-contact portion 222*a*, and the contact between the first non-contact area 180*a* and the first non-contact portion 222*a* may make troublesome noise.

In order to prevent this, the second auxiliary vibration-proof member 70 may be disposed between the first non-contact area 180*a* and the first non-contact portion 222*a* to make a gap between them, and the second auxiliary vibration-proof member 70 may have a material with a good vibration-proof property to minimize the vibration generated in the first non-contact portion 222*a*.

In addition, since there is no supporting structure between the first non-contact area 180*a* and the first non-contact portion 222*a* to support them, reliability issues about the rigidity might arise if there is an external impact on the cabinet 100. But, according to the present disclosure, with the second auxiliary vibration-proof member 70, the rigidity of the first non-contact area 180*a* and the first non-contact part 222*a* may be improved.

Although not shown in the drawing, the second auxiliary vibration-proof member 70 may be disposed not only between the first non-contact area 180*a* and the first non-contact portion 222*a* but also between the second non-contact area 180*b* and the second non-contact portion 222*b*.

The same effect as described above may also be obtained if the second auxiliary vibration-proof member 70 is disposed between the second non-contact area 180*b* and the second non-contact portion 222*b*.

Hereinafter, an outdoor unit according to another embodiment of the present disclosure will be described. Other configurations than the configurations of a bead 223' and a non-contact area 180' as will be described below are the same as the configurations of the outdoor unit of the air conditioner according to the previous embodiments of the present disclosure, so the overlapping description will be omitted below.

The beads 223 according to an embodiment of the present disclosure may be provided to project outward of the cabinet 100 so that the non-contact area 180 and the non-contact portion 222 do not contact each other.

However, due to a location where the outdoor unit lis placed, there is a possibility that the beads 223 may not protrude outward from the cabinet 100. In order to solve such a problem, the outdoor unit 1 according to another embodiment of the present disclosure may include an extension portion 181' bending toward the inside of the cabinet 100 and extending a predetermined length into the cabinet 100, and a non-contact area 180' including an inner side portion 182' extending from the upper side of the extending portion 181'.

In order to prevent the non-contact area 180' from contacting the non-contact portion 222' when the bead 223' may not protrude outward from the cabinet 100 as described above, the extending portion 181' may extend to the inside of the cabinet 100 longer than the extending portion 181 according to the previous embodiment of the present disclosure, and the inner side portion 182' may be provided to be disposed deep inside the cabinet 100.

Accordingly, the distance between the non-contact area 180' and the non-contact area 222' is formed to be long. Accordingly, even if the beads 233' do not protrude outward from the cabinet 100, a separation distance between the non-contact area 180' and the non-contact portion 222' may be maintained.

Although not shown, as the inner side portion 182' is moved inward, the distance between the coupling portion 191 and the contact portion 221 to be coupled to the blower cover 200 in the side cabinet 130 may also increase. However, if the contact portion 221 of the blower cover 200 is formed in a concave shape or the like toward the inside of the cabinet 100 as the inner side portion 182' is moved inward, the separation between the coupling portion 191 and the contact portion 221 may be reduced.

Figure 17:
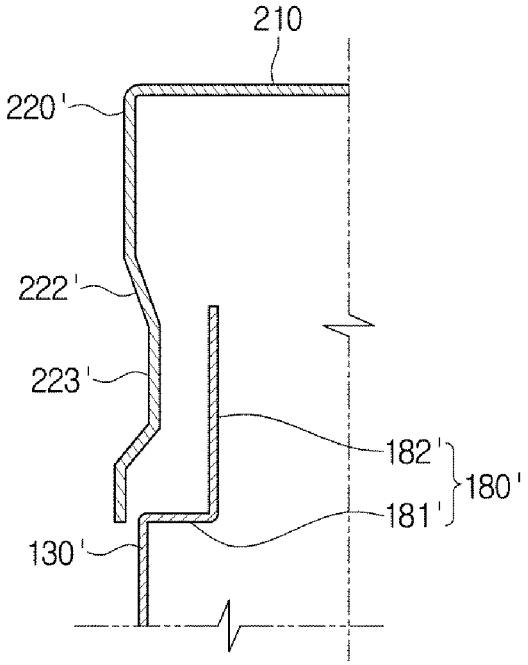
FIG. 17 is a cross-sectional view of a portion of an outdoor unit of an air conditioner according to another embodiment of the present disclosure.

Also, as shown in FIG. 17, the beads 223' may be formed to be directed toward the inner side of the cabinet 100. When the bead 223' is formed, the value of the sectional moment of the extension 220' increases, and rigidity may be ensured. Accordingly, if the bead 223' may not be formed in the outer direction of the cabinet 100, it may be formed inward to further secure the rigidity of the extension 220'.

As the inner side portion 182' is disposed deep inside the cabinet 100 when the beads 223' are formed toward the inside of the cabinet 100, the distance between the non-contact portion 222' and the non-contact region 180' is secured sufficiently to prevent the non-contact portion 222' and the non-contact area 180' from contacting each other.

Furthermore, although not shown in the drawing, the non-contact area 180' as shown in FIG. 17 may be disposed on the front cabinet 110 as well as the side cabinet 130. The beads 223' may protrude to the inner side of the cabinet 100 on the front extension 220*b* corresponding to the front cabinet 110, thereby securing rigidity of the front extension.

According to embodiments of the present disclosure, the outdoor unit 1 may reduce the number of engaging spots between the blower cover and the cabinet 100 of the outdoor unit 1, leading to a reduced production cost. The vibration generated in the outdoor unit 1 may be reduced by minimizing transmission of the vibration generated in the blower cover to the cabinet by forming a predetermined gap between the blower cover and the cabinet.

The present disclosure is not limited to the above-described embodiments, and it should be clear to those skilled in the art that various modifications and changes may be made without departing from the scope of the present disclosure. Therefore, modified or changed embodiments are included in the range of the claims of the present disclosure.

DESCRIPTION OF THE SYMBOLS

| | |
|---|---|
| 1: OUTDOOR UNIT | 2: COMPRESSOR |
| 3: HEAT EXCHANGER | 4: BLOWER |
| 5: DRIVE MOTOR | 6: BASE MEMBER |
| 7: BELL MOUTH PART | 8: DIFFUSER PART |
| 9: CONTAINER-SHAPED MOLDED OBJECT | 11: BRACKET |
| 12: FAN GUARD | 70, 90: AUXILIARY VIBRATION-PROOF MEMBER |
| 80: VIBRATION-PROOF MEMBER | 100: CABINET |
| 110: FRONT CABINET | 111: FRONT UPPER CABINET |
| 112: FRONT MIDDLE CABINET | 113: FRONT LOWER CABINET |
| 115: HOOK | 116: FIRST COUPLING HOLE |
| 117: THIRD TO FIFTH COUPLING HOLES | 120: REAR CABINET |
| 130: SIDE CABINET | 131: SUCTION PORT |
| 140: COUPLING SURFACE | 141: HOOK GROOVE |
| 142: SECOND COUPLING HOLE | 150: FIRST FRAME |
| 160: SECOND FRAME | 170: CONTACT AREA |
| 180: NON-CONTACT AREA | 190: COUPLING MEMBER |
| 191: COUPLING PORTION | 200: BLOWER COVER |
| 201: DISCHARGE PORT | 210: UPPER SURFACE |
| 220: EXTENSION | 221: CONTACT PORTION |
| 222: NON-CONTACT PORTION | 223: BEAD |

What is claimed is:

1. An outdoor unit of an air conditioner, the outdoor unit comprising:
   - a cabinet including a first plate and a second plate separate from the first plate;
   - a blower configured to be disposed inside the cabinet; and
   - a blower cover configured to cover the blower and connect to the cabinet,
   - wherein the first plate includes a contact area, in an exterior surface of the first plate, configured to directly contact the blower cover, and the second plate is configured to be separated from the blower cover while the cabinet is connected to the blower cover,
   - wherein the first plate further includes a non-contact area, in the exterior surface of the first plate, configured to be separated from the blower cover in the outward direction of the cabinet, and
   - wherein the contact area includes two contact areas respectively disposed on two ends of the first plate, and the non-contact area is provided between the two contact areas.

2. The outdoor unit of the air conditioner of claim 1, wherein the non-contact area includes a bent portion bent toward an inside of the cabinet, and an inner side portion extending upward from the bent portion.

3. The outdoor unit of the air conditioner of claim 2, wherein the blower cover is disposed apart from an exterior surface of the inner side portion.

4. The outdoor unit of the air conditioner of claim 1, wherein the blower cover includes an upper surface disposed on the cabinet and an extension bending from the upper surface and extending downward, and the extension includes a contact portion facing the contact area and a non-contact portion facing the non-contact area.

5. The outdoor unit of the air conditioner of claim 4, wherein the contact area includes a coupling portion engaged with the contact portion by a coupling member.

6. The outdoor unit of the air conditioner of claim 5, wherein the coupling portion includes two coupling portions respectively disposed on two ends of the first plate.

7. The outdoor unit of the air conditioner of claim 4, wherein the non-contact portion includes a bead protruding in an outward direction of the cabinet.

8. The outdoor unit of the air conditioner of claim 7, wherein the bead is disposed apart from the non-contact area in the outward direction of the cabinet.

9. The outdoor unit of the air conditioner of claim 4, wherein the extension is disposed apart from the second plate in an outward direction of the cabinet so that the extension is separated from the second plate.

10. The outdoor unit of the air conditioner of claim 1, wherein the first plate is disposed in a direction orthogonal to the second plate, and the second plate is hooked onto the first plate.

11. The outdoor unit of the air conditioner of claim 10, wherein the second plate includes a hook formed on one side of an inner surface of the second plate, the first plate includes a coupling surface bending toward the second plate and coupled with the inner surface of the second plate, and the coupling surface includes a hook groove into which the hook is hooked.

12. The outdoor unit of the air conditioner of claim 11, wherein a side opposite the inner surface of the second plate is coupled with the coupling surface by a coupling member.

13. The outdoor unit of the air conditioner of claim 4, further comprising a vibration-proof member disposed between an inner surface of the upper surface and an upper side of the second plate, wherein the vibration-proof member comprises an insertion groove into which an upper end of the second plate is inserted.

14. An outdoor unit of an air conditioner, the outdoor unit comprising:

a cabinet including a pair of first plates and a pair of second plates separate from the pair of first plates;

a blower configured to be disposed inside the cabinet; and a blower cover configured to cover the blower and connect to the cabinet, wherein the cabinet further comprises a contact area configured to directly contact an interior surface of the blower cover and a non-contact area configured to be separated from the blower cover while the cabinet is connected to the blower cover, and the contact area is disposed on an exterior surface of the pair of first plates, wherein the non-contact area includes a first non-contact area disposed on the pair of first plates and a second non-contact area disposed on the pair of second plates, wherein the blower cover includes a contact portion facing the contact area, and first and second non-contact portions facing the first and second non-contact areas, respectively, and wherein the first non-contact portion includes a bead protruding in an outward direction of the cabinet.

15. The outdoor unit of the air conditioner of claim 14, wherein the first non-contact portion is disposed apart from the first plate in the outward direction of the cabinet, and the second non-contact portion is disposed apart from the second plate in the outward direction of the cabinet.

16. The outdoor unit of the air conditioner of claim 14, wherein the first non-contact area includes a bent portion bending toward an inside of the cabinet and an inner side portion extending upward from the bent portion, and the inner side portion is disposed apart from the bead in the outward direction of the cabinet.

* * * * *